US009248483B2

(12) United States Patent
Kümmerling et al.

(10) Patent No.: US 9,248,483 B2
(45) Date of Patent: Feb. 2, 2016

(54) METHOD AND DEVICE FOR THE OPTIMIZED CIRCULATION OF RODS IN THE PRODUCTION OF A SEAMLESSLY HOT-FABRICATED STEEL PIPE ACCORDING TO THE CONTINUOUS PIPE METHOD

(75) Inventors: Rolf Kümmerling, Duisburg (DE); Frank Hagemann, Düsseldorf (DE); Gabriel Moniz Pereira, Oberhausen (DE); Nils Schäfer, Düsseldorf (DE); Ken Johnson, Petersburg, OH (US); Brad Chamberlain, Boardman, OH (US)

(73) Assignee: VALLOUREC DEUTSCHLAND GMBH, Düsseldorf (DE)

( * ) Notice: Subject to any disclaimer, the term of this patent is extended or adjusted under 35 U.S.C. 154(b) by 768 days.

(21) Appl. No.: 13/505,326

(22) PCT Filed: Oct. 25, 2010

(86) PCT No.: PCT/DE2010/001252

§ 371 (c)(1),
(2), (4) Date: Jun. 14, 2012

(87) PCT Pub. No.: WO2011/050783

PCT Pub. Date: May 5, 2011

(65) Prior Publication Data

US 2012/0272704 A1 Nov. 1, 2012

(30) Foreign Application Priority Data

Nov. 2, 2009 (DE) ..... 10 2009 053 166

(51) Int. Cl.

| | |
|---|---|
| ***B21B 17/04*** | (2006.01) |
| ***B21B 25/06*** | (2006.01) |
| *B21B 25/00* | (2006.01) |

(52) U.S. Cl.
CPC ..... *B21B 17/04* (2013.01); *B21B 25/06* (2013.01); *B21B 25/00* (2013.01)

(58) Field of Classification Search
CPC ..... B21B 25/06; B21B 25/00; B21B 25/04
USPC ..... 72/200, 201, 208, 209, 236; 29/33 D
See application file for complete search history.

(56) References Cited

U.S. PATENT DOCUMENTS 3,946,586 A 3/1976 Calmes
5,584,203 A * 12/1996 Eversberg et al. ..... 72/209

(Continued)

FOREIGN PATENT DOCUMENTS

DE 33 35 942 A1 4/1984
EP 1 854 561 A1 11/2007

(Continued)

*Primary Examiner* — Debra Sullivan
(74) *Attorney, Agent, or Firm* — Henry M. Feiereisen LLC.

(57) ABSTRACT

A device for the optimized circulation of mandrels includes a presentation and/or cooling table for mandrel rods, a lubricating station for the mandrel rods, optionally an additional drying station for the lubricant applied to the mandrels, and associated roller conveyors. An additional secondary rod circulation of is arranged upstream of the standard rod circulation and includes two redundantly operating transfer tables connected to the presentation and/or cooling table by a third roller conveyor or the first roller conveyor for the discharge of no longer needed rods from the standard rod circulation. The third roller conveyor either forms the continuation of the first roller conveyor or is arranged parallel thereto with an offset. A fourth roller conveyor for accommodating mandrel rods or passing mandrel rods intermittently into the standard circulation via an intermediate buffer is arranged on the opposite side of the transfer tables parallel to the first roller conveyor.

27 Claims, 2 Drawing Sheets

(56) References Cited

U.S. PATENT DOCUMENTS

| | | | |
|---|---|---|---|
| 2009/0044883 | A1 | 2/2009 | Kümmerling et al. |
| 2009/0113970 | A1 | 5/2009 | Kümmerling et al. |
| 2010/0251794 | A1 | 10/2010 | Kümmerling et al. |

FOREIGN PATENT DOCUMENTS

| | | |
|---|---|---|
| GB | 2 128 119 | 4/1984 |
| GB | 2 036 622 A | 2/1998 |

* cited by examiner

METHOD AND DEVICE FOR THE OPTIMIZED CIRCULATION OF RODS IN THE PRODUCTION OF A SEAMLESSLY HOT-FABRICATED STEEL PIPE ACCORDING TO THE CONTINUOUS PIPE METHOD

CROSS-REFERENCES TO RELATED APPLICATIONS

This application is the U.S. National Stage of International Application No. PCT/DE2010/001252, filed Oct. 25, 2010, which designated the United States and has been published as International Publication No. WO 2011/050783 and which claims the priority of German Patent Application, Serial No. 10 2009 053 166.1, filed Nov. 2, 2009, pursuant to 35 U.S.C. 119(a)-(d).

BACKGROUND OF THE INVENTION

The invention relates to a method for optimized circulation of rods in the production of a seamlessly hot-fabricated steel pipe using the continuous pipe method, and a device for carrying out the method.

When producing seamless pipes using the so-called continuous pipe method (continuous rolling method), a solid round steel bar is initially heated to a rolling temperature of about 1250° C. This is typically done in a rotary hearth furnace. The round steel bar is then pierced into a thin-wall hollow block, typically with a cross roll piercing mill.

The hollow block is subsequently rolled at the same temperature in a multi-frame continuous rolling mill into a shell using a mandrel rod and into a pipe having the final dimensions in a subsequent reduction rolling mill or sizing mill.

To allow the hollow block to be rolled to slide on the mandrel rod in the continuous rolling mill after the mandrel rod has been maneuvered into the hollow block which is stretched longitudinally during rolling, a lubricant must be applied to the mandrel rod. The lubricant is typically applied on the mandrel rod in liquid form and dried until the time of use.

The rod must be cooled after rolling to prepare the rod for the next use or to store the rod.

To improve the utilization of the rolling mill and achieve optimal conditions of the mandrel rods with respect to the surface characteristics, lubrication and temperature, it is known, for example from DE 33 35 942 A1, to arrange a so-called (mandrel) rod circulation upstream of the actual rolling mill as standard equipment, which includes all necessary stations for preparing the mandrel rods and has approximately 4 to 8 mandrel rods in form of a mandrel rod set circulating simultaneously.

Specifically, the standard rod circulation includes the following steps:

- lubricating and drying the lubricant on the still warm mandrel rod,
- maneuvering the mandrel rod (A) into the hollow block, rolling the hollow block and stripping the shell from the mandrel rod,
- returning the used hot mandrel rod to a cooling conveyor with selective precooling,
- cooling the mandrel rod on the cooling conveyor, and in the event of reuse
- transferring the mandrel rod to the supply roller conveyor for lubrication and repetition of the cycle.

Due to this repeating cycle, a mandrel rod is always ready for use at the beginning of the rolling process.

When changing the mandrel rod set to a different dimension, the rods of the circulating set are removed via a discharge table and the rods of the new set are inserted via a presentation table. Because the cycle times have to be maintained, this may lead to dead times of the rolling mill, when the rods with the next dimension are not available in time.

To ensure that a mandrel rod with a suitable dimension and with a dried lubricant is available on the feed into the rolling mill, three possibilities exist when changing dimensions:

1. The mandrel rods are heated before their use, the lubricant is subsequently applied, and the rod is inserted for rolling shortly after having been dried.
2. The mandrel rods are lubricated after removal from the standard rod circulation and are stored after natural or accelerated drying. Re-lubrication due to flaws caused by handling of the rods may be required before reuse.
3. The use of rapidly drying special lubricants which dry sufficiently fast even when the rods are not preheated.

Due to a worldwide increase in rolling mill capacity, more and more special programs must be performed in a continuous rolling mill. This specialization means, on one hand, an increase of the number of different rolling lots with different materials and dimensions and, on the other hand, a decrease in the number of pipes being rolled in a rolling lot. The smallest rolling lot unit is a single pipe to be rolled on a corresponding mandrel rod.

As a result, with small and extremely small rolling lots and frequent dimensional changes, it is frequently necessary to change from one set of mandrel rods to another set or from one size of mandrel rods to the next size.

To minimize downtimes in the rolling mill, the rolling lots are sorted so that a dimensional change requires the shortest possible conversion time. Longer-time conversions, for example for a block change, are planned less frequently, shorter-time conversions, such as major and minor gauge changes, are planned more frequently.

However, the aforedescribed measures are not adequate for rolling programs requiring a consecutive fast changes of the mandrel rods with other diameters. In particular, it has been observed that the rod circulation practiced to date cannot be optimally matched to rolling of smaller lots, for example when the number of pipes to be rolled is identical to or only insignificantly larger than the number of provided mandrel rods. When a mandrel rod change is required, a readily usable mandrel rod may not always be available on the presentation unit at the time of the planned rolling start, already causing downtimes.

In particular, the often very long preheating times of a mandrel rod or of a mandrel rod set and inadequately sized transport and storage facilities for a frequent rod change may also result in longer downtimes and thus an uneconomical production.

It is therefore an object of the invention to provide a method for optimized rod circulation in the production of a seamlessly hot-fabricated steel pipe using the continuous pipe method, with which also small or extremely small rolling lots can be produced economically due to a rapid rod change. A corresponding device will also be described.

SUMMARY OF THE INVENTION

This object is attained by a method for optimized circulation of mandrel rods during the production of a seamless hot-fabricated steel pipe according to the continuous pipe method, wherein a standard rod circulation is arranged upstream of a multi-frame continuous rolling mill for supplying, removing and reprocessing of the mandrel rods, wherein when dimensions are changed at least the required number of mandrel rods with the same diameter (A) is provided for rolling a single dimension and wherein the standard rod circulation includes steps of lubricating a mandrel rod and drying the lubricant on the mandrel rod, maneuvering the mandrel rod into the hollow block, rolling the hollow block and stripping the shell from the mandrel rod, returning the used hot mandrel rod to a cooling or presentation table, cooling the mandrel rod on the cooling table, and during reuse, transferring the cooled, but still warm mandrel rod to the supply roller conveyor for lubrication and repeating the cycle.

According to the teaching of the invention, a second circulation in form of a secondary rod circulation is arranged upstream of the standard rod circulation to enable rapid change from a mandrel rod set with a diameter (A) to mandrel rods with a different diameter (B), (C), (D), etc., in which instead of providing mandrel rods with other diameters (B), (C), (D), etc., on the presentation table of the standard rod circulation for the impending change in dimensions, the subsequent mandrel lots with the required diameters (B), (C), (D), etc., are placed in and/or removed from the secondary rod circulation by at least two redundantly operating transfer tables and selectively preheated, and selectively inserted in the standard rod circulation after having optionally been provided with lubricant, and the no longer required mandrel lots with the dimension (A) are removed from the standard rod circulation and subsequently either stored away or returned to the standard rod circulation via one of the aforementioned transfer tables.

It was recognized during simulations for optimizing the rod circulation for small rolling lots in relation to realizing rapid rod changes, that the rod change in the continuous rolling mill must be designed such that the two transfer tables are each able to accept at least one complete rod set, in order to realize rapid insertion of the mandrel rods into and withdrawal of the mandrel rods from the standard rod circulation. The transfer tables are hereby configured according to the invention so as to operate redundantly. According to the invention, the mandrel lots from the secondary rod circulation are inserted into the standard rod circulation via an intermediate buffer which may be constructed as a presentation table or as an oven.

This boundary condition is completely satisfied by arranging the secondary rod circulation upstream of the standard rod circulation for the rolling. The secondary rod circulation is hereby primarily used for rod management when changing rod sets.

With the proposed method, the rod sets required for rolling are advantageously inserted and removed via the secondary rod circulation by the two redundantly operating transfer tables, so that a rapid change to other rod dimensions becomes feasible as often as desired.

Another technical prerequisite in the standard rod circulation is that the lubricant must be dried when the rod is inserted into the hollow block.

According to the invention and depending on the application, the rod may be lubricated and the lubricant may be dried in corresponding lubrication and drying stations in the standard rod circulation or in the secondary rod circulation, thus producing synergistic effects with the common use of storage containers and the like.

When lubricating the rods in the secondary rod circulation, the lubricant is dried actively with a corresponding fast drying lubricant component or naturally or passively accelerated, whereby the rods are hereby intermediately stored on the presentation table or alternatively in the oven operating as the intermediate buffer. The rods are then supplied via this intermediate buffer to the standard rod circulation.

Passive accelerated drying of the lubricant on the mandrel rod may be performed either with a hot gas, such as air, or with hot (oven) exhaust gases or simply with moving dry air.

When the rods are lubricated in the standard rod circulation, the lubricant may be dried by heating the rods in any (advantageous) combination with an oven or other heating systems before, in or after the intermediate buffer.

Advantageously, separate lifting beams may be provided for the intermediate buffer constructed as a presentation table or as an oven for continuous transport of the rods, thereby closing most of the possible gaps that occur when separately movable lifting beams are used. The gaps may also be closed, especially in a undivided lifting beam system, by way of rapid transport (e.g., carriages).

It was also observed during operational experiments that the mandrel rods should be inserted and removed during the rod circulation without crossing each other, in order to avoid unnecessary wait times when rods are transported in opposite directions.

For crossing-free insertion and removal of the mandrel rods into/from the standard rod circulation, the rods are therefore inserted and/or removed according to the invention via additional parallel roller conveyors with corresponding transfer points.

According to the invention, the transfer tables transport the rods in a first embodiment in opposite directions, thus requiring a second supply roller conveyor to the transfer tables for preventing the rod flows from crossing over. The intermediate buffer can be circumvented when the rods are only intermediately stored on the transfer tables for short time. For this purpose, the second supply roller conveyor is extended for directly reinserting the rods in the direction of the supply roller conveyor in the standard rod circulation.

In a second embodiment, the rods are transported across the transfer tables in only one direction, thereby obviating the need for a second supply roller conveyor.

Advantageously, the rods may be transported and stored in a cassette system, and a separate crane may service the two transfer tables according to the invention and the mandrel rod store.

The transport with a cassette system is advantageously automated and coupled with a rod store administration computer for further increasing the efficiency.

BRIEF DESCRIPTION OF THE DRAWING

The method according to the invention will be described in more detail with reference to two schematic diagrams.

It is shown in

DETAILED DESCRIPTION OF PREFERRED EMBODIMENTS

Figure 1:
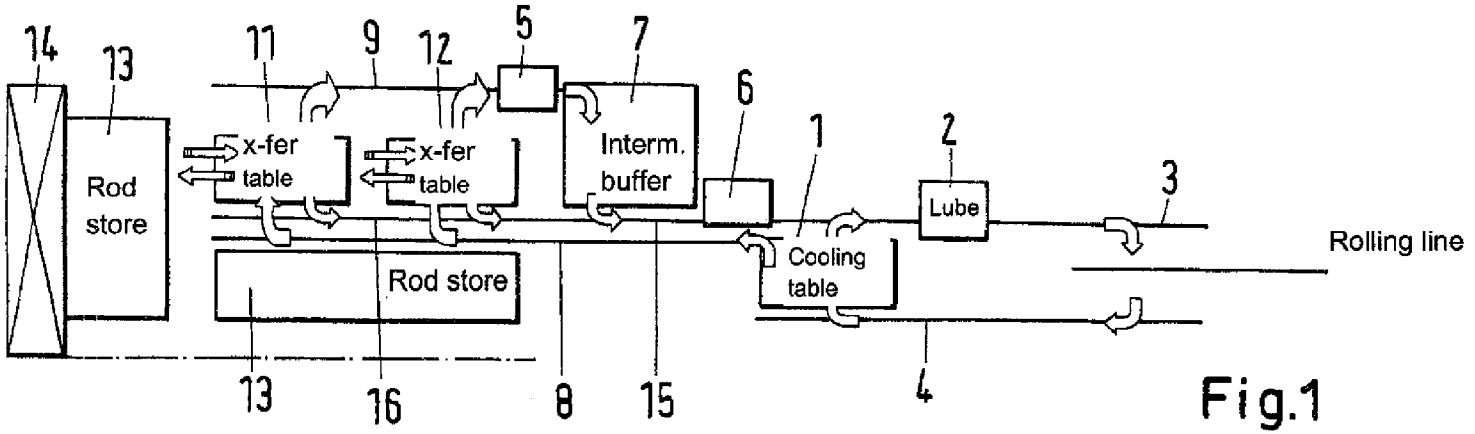
FIG. 1 a layout of a first variant of the device according to the invention for rapid rod circulation, FIG. 2*a* a layout of a second variant of the device according to the invention for rapid rod circulation, and FIG. 2*b* a diagram identical to FIG. 2*a*, except for an illustration of the circulation of mandrel rods with different diameters.

FIG. 1 shows the layout of a first variant of the device according to the invention for fast rod circulation during dimensional changes. The reference symbol in the square box relate to facility parts for (intermediate) storage, handling and preparation of the mandrel rods, the other boxes refer to rolling conveyors or a crane for transporting the mandrel rods, In this variant, the mandrel rods are heated in the secondary rod circulation to achieve rapid drying of the lubricants on the mandrel rod.

The device is substantially formed of an (unillustrated) rolling assembly of a continuous rolling mill (see rolling line) with a standard rod circulation for supplying, removing and reprocessing the mandrel rods, with a secondary rod circulation arranged upstream of the standard rod circulation. The circulation of the mandrel rods is indicated by the arrows.

The standard rod circulation itself is formed of a presentation or cooling table 1 for the mandrel rods, a lubrication station 2 for applying lubricant on the mandrel rod which is still warm from the rolling process, a first roller conveyor 3 for supplying the mandrel rods to the rolling assembly, and another second roller conveyor 4 arranged in parallel with the first roller conveyor 3 for removing used mandrel rods from the rolling assembly to the presentation or cooling table 1.

The secondary rod circulation according to the invention arranged upstream for a fast dimensional change includes substantially two redundantly operating transfer tables 11 and 12 which are connected with the presentation or cooling table 1 via a third roller conveyor 8 for removing used rods from the standard rod circulation.

Moreover, the secondary rod circulation is constructed of a fourth roller conveyor 9 arranged on the opposite side of the transfer tables 11 and 12 in parallel with the third roller conveyor 8 for receiving or transporting onward mandrel rods from the transfer tables 11 and 12 via an intermediate buffer 7 into the standard rod circulation.

When the mandrel rods are intermediately stored on one of the transfer tables 11 or 12 only for short time, the intermediate buffer 7 may be circumvented, wherein the mandrel rods are directly reinserted into the standard rod circulation from the transfer table 11 or 12, selectively with inductive preheating 6. According to the invention, the transfer tables 11 and 12 are here connected with the first roller conveyor 3 via a roller conveyor section 15 and an additional roller conveyor section 16, so that a crossing-free direct reinsertion into the standard rod circulation can be realized during insertion via the transfer table 12 and reinsertion during introduction via the transfer table 11 becomes possible without cycle time losses. The transfer tables 11 and 12 are herein used both for new insertion as well as for reinsertion of already warm mandrel rods, which can be accomplished without any problem through transport via the parallel roller conveyors 3, 15, 16 and 8, respectively.

The direction for insertion and removal and onward transport of the mandrel rods is indicated by the drawn arrows.

Depending on the application, the intermediate buffer 7 may either be an additional transfer table or an oven, wherein the mandrel rods can be heated in any combination by additional heating devices 5 and 6, before, in or after the intermediate buffer 7. The transfer tables 11 and 12 are supplied with mandrel rods from one or several rod stores 13 with a crane 14.

Figure 2A:
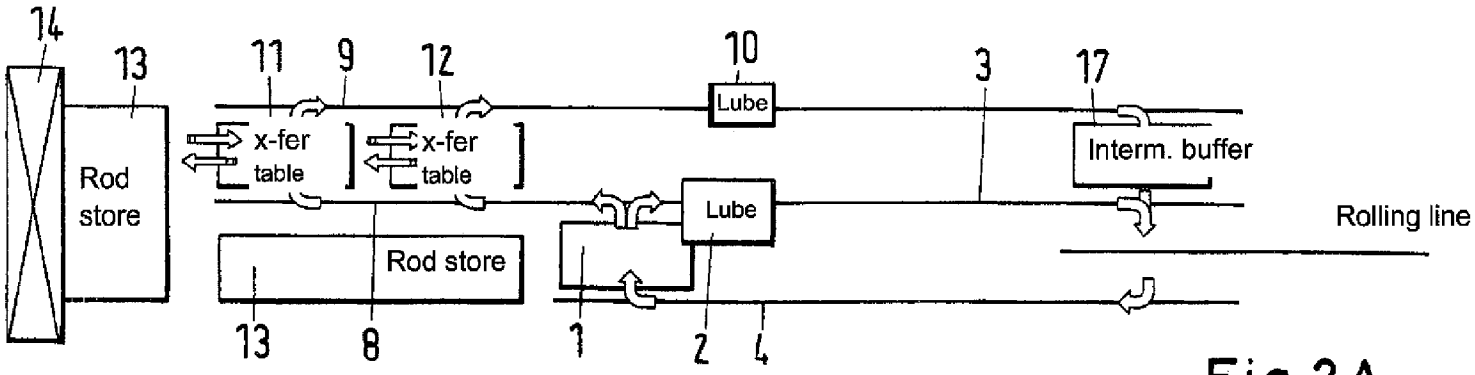

FIG. 2*a* shows a layout of a second variant of the device according to the invention. Identical reference symbols refer to identical features of the device.

This variant is different from the first embodiment in that the mandrel rods are not preheated in the secondary rod circulation before the lubricant is applied, and the lubricant is instead dried on a drying table as an intermediate buffer 17 after application of the lubricant, wherein the intermediate buffer 17 can optionally also be constructed as an oven.

In addition, unlike the embodiment of FIG. 1, the mandrel rods are cycled across the transfer tables 11 and 12 in only one direction, thus enabling insertion and removal of the mandrel rods without crossing each other and without employing an additional roller conveyor.

The mandrel rods to be removed from the standard rod circulation are hereby transported via the third roller conveyor 8 from the presentation table 1 to the transfer tables 11 and 12, respectively. The third roller conveyor 8 is constructed here as an extension of the first roller conveyor 3.

The first roller conveyor 3 need not be extended by the third roller conveyor 8 for a direct removal from the first roller conveyor 3 to the transfer tables 11 and 12, respectively.

For insertion of new mandrel rods from the secondary rod circulation into the standard rod circulation, the transfer tables 11 and 12 are connected via the fourth roller conveyor 9 with a lubricant station 10 and the intermediate buffer 17 constructed as a drying table or an oven. The mandrel rods are subsequently inserted into the standard rod circulation from the intermediate buffer 17.

Figure 2B:
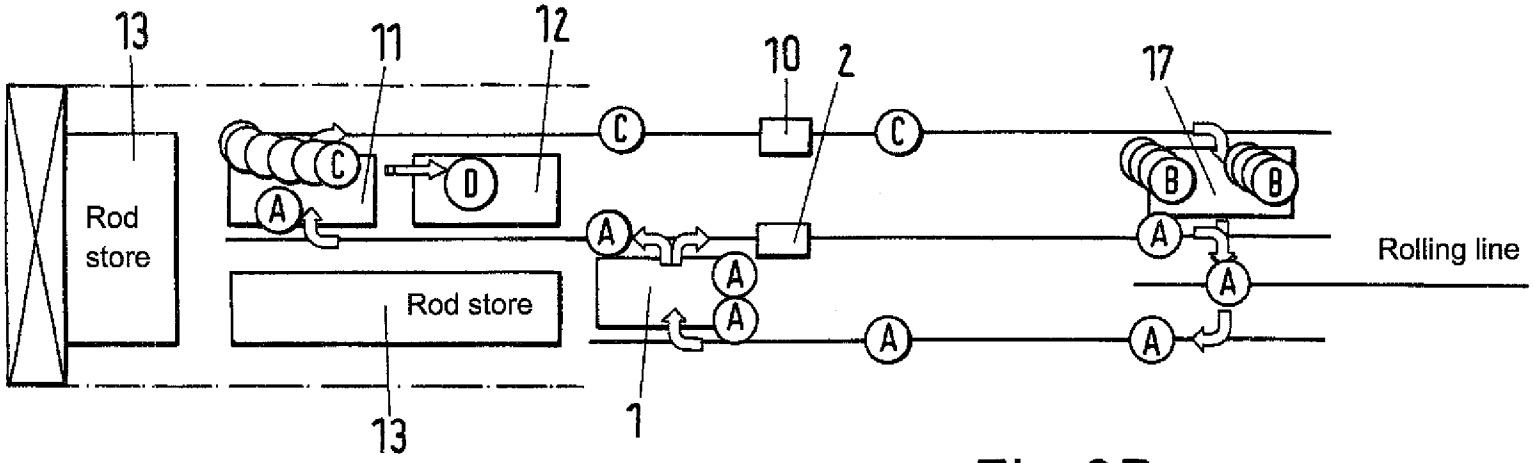

FIG. 2*b* illustrates in form of an example the rapid circulation of mandrel rods with different diameters according to the layout of FIG. 2*a*. In the following, reference will be made to the reference symbols of FIG. 2*a*.

The circles with the letters A, B, C, D symbolize mandrel rods with different diameters which are to be used consecutively during rolling.

In the present example, the mandrel rod set with a diameter A is used initially, i.e. it is located in the standard rod circulation. For a dimensional change to the diameter B, the rods with the diameter A are transported in steps via the second roller conveyor 4 and the presentation table 1 into the secondary rod circulation to the transfer table 11 via the third roller conveyor 8.

Mandrel rods with the next required diameter of the dimension B are already ready for use (i.e., lubricated and dried) on the intermediate buffer 17 constructed as a drying table and can be immediately employed for rolling after the last mandrel rod A is removed from the standard rod circulation.

The subsequent mandrel rods with the dimension C are provided via the transfer table 11, on which a complete mandrel rod set with this dimension is already located.

After the first rods B have been used, the mandrel rods with the dimension C are successively supplied to the lubricant station 10 and thereafter to the intermediate buffer 17 constructed as a drying table.

During this time, a crane 14 already supplies the transfer table 12 from the rod store 13 with rods of the dimension D, so that all required mandrel rod dimensions can be provided to the rolling mill at the required time, without causing downtime.

LIST OF REFERENCE SYMBOLS

| No. | Designation |
|---|---|
| 1 | Cooling and/or presentation table |
| 2 | Lubrication station |
| 3 | Roller conveyor for supplying mandrel bars to the rolling unit |
| 4 | Roller conveyor for removing mandrel bars from the rolling unit |
| 5, 6 | Inductive heating |
| 7 | Intermediate buffer |
| 8 | Roller conveyor for discharging |
| 9 | Roller conveyor for feeding |
| 10 | Lubrication station |
| 11, 12 | Transfer table |
| 13 | Rod store |

-continued

| No. | Designation |
|---|---|
| 14 | Crane |
| 15, 16 | Roller conveyor section |
| 17 | Intermediate buffer |

The invention claimed is:

1. A method for optimized circulation of mandrel rods during production of a seamless hot-fabricated steel pipe according to the continuous pipe method, comprising the steps of:

arranging a standard rod circulation upstream of a multi-frame continuous rolling mill for supplying, removing and reprocessing of the mandrel rods, providing, when a dimension is changed, at least a required number of mandrel rods with identical diameter for rolling a single dimension, and with the standard rod circulation performing the steps of:

(a) applying a lubricant on a mandrel rod and drying the lubricant on the mandrel rod, (b) conveying the mandrel rod into a hollow block, rolling the hollow block and stripping a shell from the mandrel rod, (c) returning the used hot mandrel rod to a cooling or presentation table, (d) cooling the mandrel rod on the cooling table, and (e) when reusing the mandrel rod, transferring the cooled, but still warm mandrel rod to a supply roller conveyor for lubrication, and repeating steps (a) through (e), arranging a second circulation in form of a secondary rod circulation upstream of the standard rod circulation, thereby enabling changing from one mandrel rod set with a first diameter to mandrel rods with at least one second diameter;

when a change in dimensions is impending, instead of providing mandrel rods with the at least one second diameter on the presentation table of the standard rod circulation, placing the mandrel rods having the at least one second diameter on at least two redundantly operating transfer tables of the secondary circulation, removing the mandrel rods having the at least one second diameter from the at least two redundantly operating transfer tables, and inserting the removed mandrel rods, which immediately follow the mandrel rod set with the first diameter, in the standard rod circulation, removing the mandrel rods with the first diameter that are no longer required from the standard rod circulation, and storing or returning the no longer required mandrel rods to the standard rod circulation via one of the at least two transfer tables.

2. The method of claim 1, wherein the mandrel rods with the first diameter and the mandrel rods with the second diameter are lubricated and dried in the standard rod circulation or in the secondary rod circulation.

3. The method of claim 1, wherein mandrel rods with the first diameter and the mandrel rods with the second diameter are inserted from the secondary rod circulation into the standard rod circulation via an intermediate buffer.

4. The method of claim 3, wherein the mandrel rods with the first diameter and the mandrel rods with the second diameter are inserted via a transfer table or a drying table or an oven as an intermediate buffer.

5. The method of claim 4, wherein the mandrel rods are heated before or after being supplied to the intermediate buffer.

6. The method of claim 5, wherein the mandrel rods are heated inductively.

7. The method of claim 4, wherein the mandrel rods are inductively heated in the intermediate buffer.

8. The method of claim 1, wherein the lubricant comprises fast drying lubricant components.

9. The method of claim 1, wherein the lubricant is dried in still air or passively accelerated.

10. The method of claim 9, wherein the lubricant is dried passively accelerated in moving dry air or heated gas.

11. The method of claim 1, wherein the mandrel rods are preheated and a lubricant is applied to the mandrel rods disposed on the at least two redundantly operating transfer tables.

12. A device for optimized circulation of mandrel rods in production of a seamlessly hot-processed steel pipe from a hollow block according to a continuous pipe method, comprising:

a standard rod circulation for supplying, removing and reprocessing of the mandrel rods arranged upstream of a multi-frame continuous rolling mill, a presentation or cooling table for the mandrel rods, a lubrication station for applying a lubricant to the mandrel rods, a first roller conveyor for conveying lubricated mandrel bars into the hollow block disposed in the rolling mill, a second roller conveyor arranged in parallel with the first roller conveyor for removing used mandrel rods from the rolling assembly to the presentation or cooling table, a third roller conveyor either forming an extension of the first roller conveyor or arranged in parallel with the first roller conveyor with an offset, an additional rod circulation in form of a secondary rod circulation arranged upstream of the standard rod circulation, said secondary rod circulation comprising two redundantly operating transfer tables, which are connected with the presentation or cooling table via the third roller conveyor or the first roller conveyor for removing rods that are no longer required from the standard rod circulation, and a fourth roller conveyor arranged on an opposite side of the transfer tables in parallel with the first roller conveyor for receiving or transporting mandrel rods onward to the standard rod circulation via an intermediate buffer.

13. The device of claim 12, wherein the intermediate buffer comprises an oven or another transfer table.

14. The device of claim 13, further comprising an additional heating device arranged upstream or downstream, or both upstream and downstream, of the intermediate buffer.

15. The device of claim 14, wherein the additional heating device comprises an induction coil.

16. The device of claim 13, wherein the additional transfer table comprises a drying unit.

17. The device of claim 16, wherein the drying unit comprises a heat-radiating device.

18. The device of claim 17, wherein the heat-radiating device comprises a microwave device, an infrared radiator or a hot air blower.

19. The device of claim 12, wherein the third roller conveyor has an offset from the first roller conveyor and is configured for re-insertion of warm mandrel rods into the standard rod circulation, and wherein the two redundantly operating transfer tables are connected with the first roller conveyor in a linear arrangement on the same side of the table by way of an additional roller conveyor constructed from roller conveyor sections and arranged in parallel with the third roller conveyor.

20. The device of claim 12, wherein the intermediate buffer is constructed as a drying table or as an oven.

21. The device of claim 20, further comprising an additional lubrication station is arranged upstream of the intermediate buffer.

22. The device of claim 12, further comprising a cassette system for transporting and storing the mandrel rods.

23. The device of claim 12, wherein the mandrel rods are conveyed to the transfer tables from at least one rod store.

24. The device of claim 23, wherein the mandrel rods are conveyed with a crane.

25. The device of claim 12, wherein transport of the mandrel rods is automatic.

26. The device of claim 12, further comprising a rod store administration computer for administering storage of the mandrel rods.

27. The device of claim 12, further comprising an additional drying station for drying the lubricant applied to the mandrel rods.

* * * * *